US005836801A

United States Patent [19]

Lin

[11] Patent Number: 5,836,801

[45] Date of Patent: Nov. 17, 1998

[54] CLIMBING TOY DEVICE

[76] Inventor: Kuo Jung Lin, No. 100, Lane 175, Cheng Kung Road, Tainan, Taiwan

[21] Appl. No.: 815,204

[22] Filed: Mar. 12, 1997

[51] Int. Cl.[6] ..... A63H 11/04

[52] U.S. Cl. ..... 446/315; 446/229; 446/490

[58] Field of Search ..... 446/228, 489, 446/490, 491, 229, 314, 315

[56] References Cited

U.S. PATENT DOCUMENTS

| | | | |
|---|---|---|---|
| 545,958 | 9/1895 | Hoffmann | 446/315 |
| 1,441,055 | 1/1923 | Bellew | 446/315 |
| 1,472,842 | 11/1923 | Hyman | 446/315 |
| 3,000,138 | 9/1961 | Tagliaferri | 446/229 |
| 3,078,614 | 2/1963 | Fors et al. | 446/314 |
| 3,535,589 | 10/1970 | Spilhaus | 446/229 |
| 3,693,290 | 9/1972 | Breslow et al. | 446/229 |
| 4,878,868 | 11/1989 | Shaw | 446/490 |
| 5,320,572 | 6/1994 | Chen | 446/229 |

*Primary Examiner*—Robert A. Hafer
*Assistant Examiner*—Jeffrey D. Carlson
*Attorney, Agent, or Firm*—Bacon & Thomas

[57] ABSTRACT

A climbing toy device has a ring, a first climbing toy, a climbing mechanism disposed in the first climbing toy, a rope connected to the ring and the climbing mechanism, a second climbing toy, and a string connected to the ring and the second climbing toy.

2 Claims, 5 Drawing Sheets

CLIMBING TOY DEVICE

BACKGROUND OF THE INVENTION

The invention relates to a climbing toy device. More particularly, the invention relates to a climbing toy device which has a first climbing toy and a second climbing toy.

Referring to FIG. 1, a conventional climbing toy device has a ring 12, a decorative toy 10, a climbing mechanism 1 disposed in the decorative toy 10, and a string 11 connected to the ring 12 and the climbing mechanism 1. Therefore, the climbing mechanism 1 can climb upward along the string 11. However, the conventional climbing toy device provides a single decorative toy 10 only.

SUMMARY OF THE INVENTION

An object of the invention is to provide a climbing toy device which has a first climbing toy and a second climbing toy to climb upward separately.

Accordingly, a climbing toy device comprises a ring, a first climbing toy, a climbing mechanism disposed in the first climbing toy, a rope connected to the ring and the climbing mechanism, a second climbing toy, and a string connected to the ring and the second climbing toy. Therefore, the climbing mechanism climbs upward along the rope with the first climbing toy. The first climbing toy will touch the second climbing toy and climb upward with the second climbing toy. When the second climbing toy touches the ring, the climbing mechanism will descend.

DETAILED DESCRIPTION OF THE INVENTION

Figure 1:
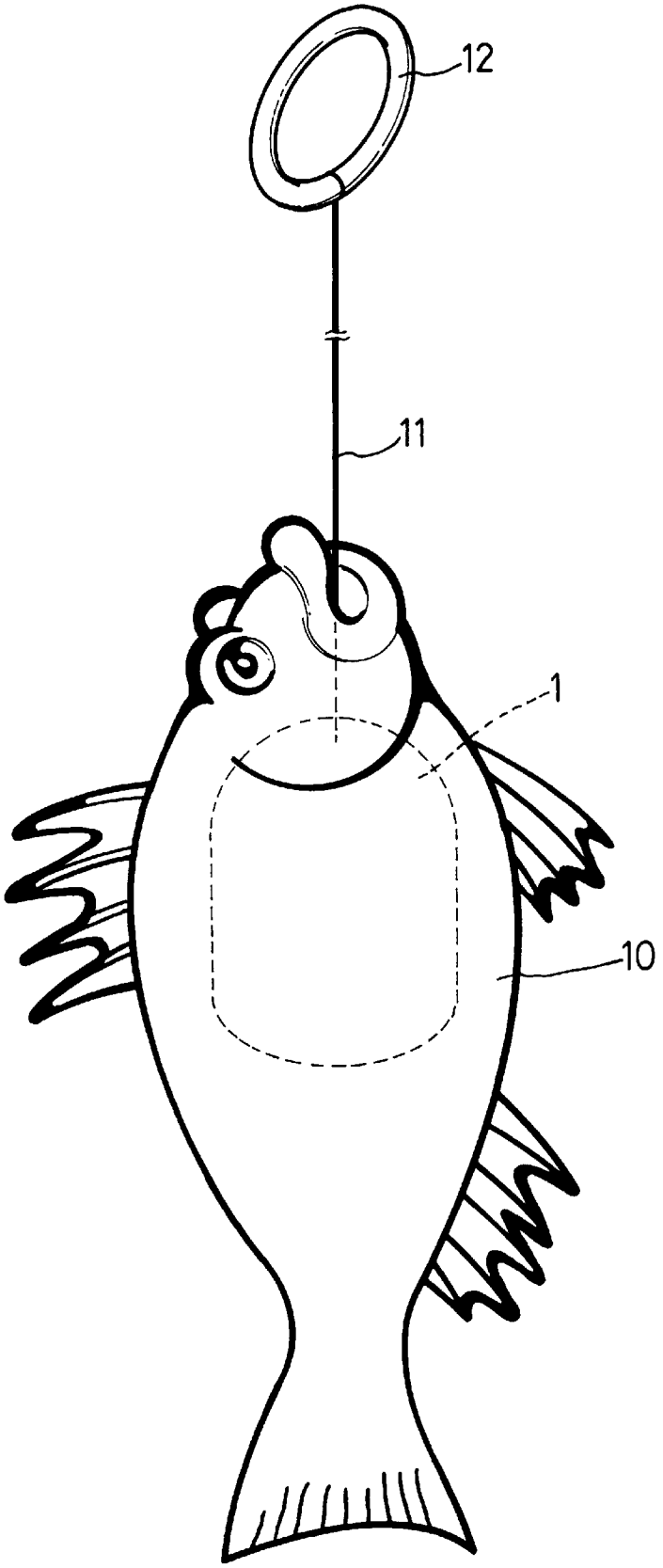
FIG.1 (PRIOR ART)
FIG. 1 is a perspective view of a conventional climbing toy device of the prior art.
Figure 2:
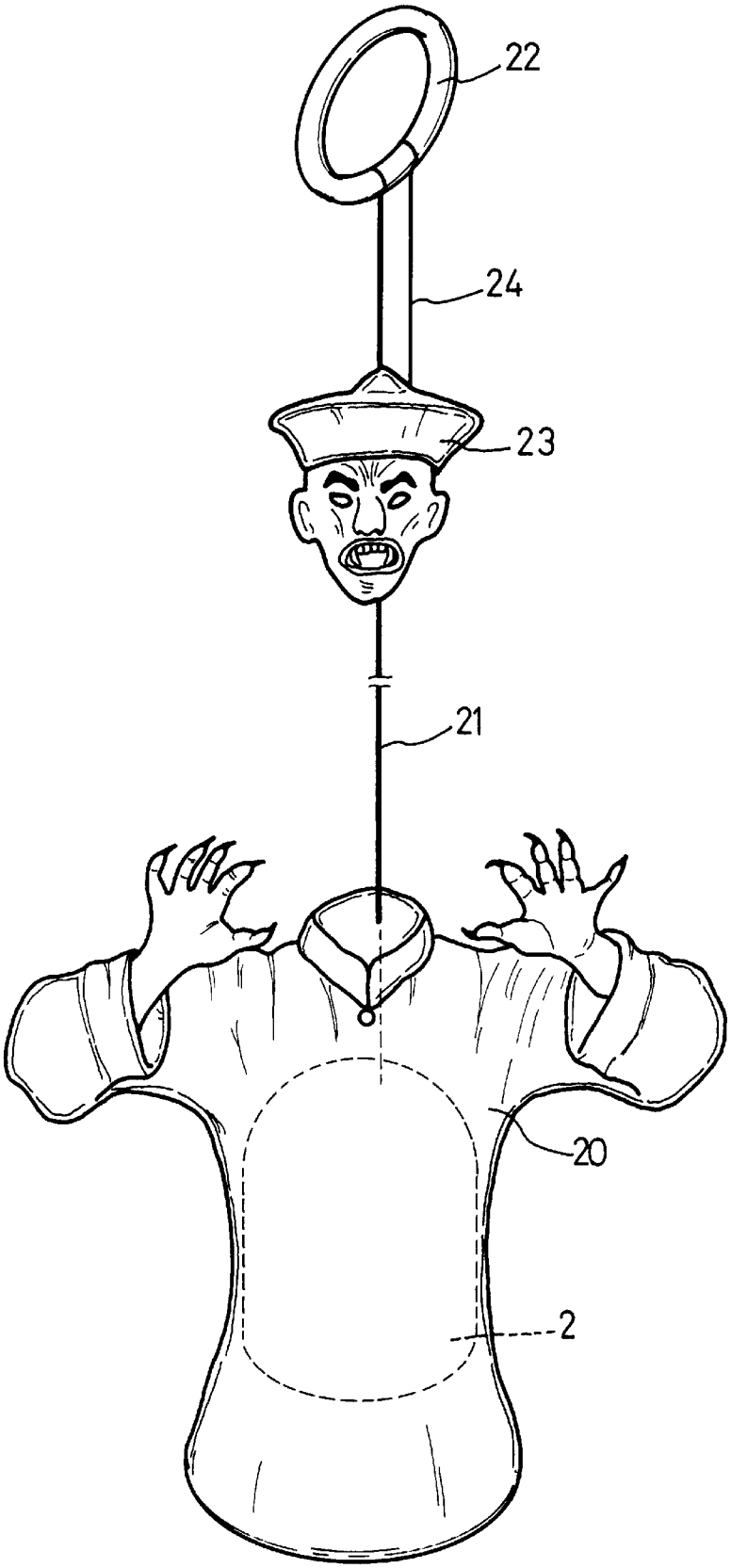
FIG. 2 is a perspective view of a climbing toy device of a preferred embodiment in accordance with the invention while the first climbing toy and the second climbing toy are separated.
Figure 3:
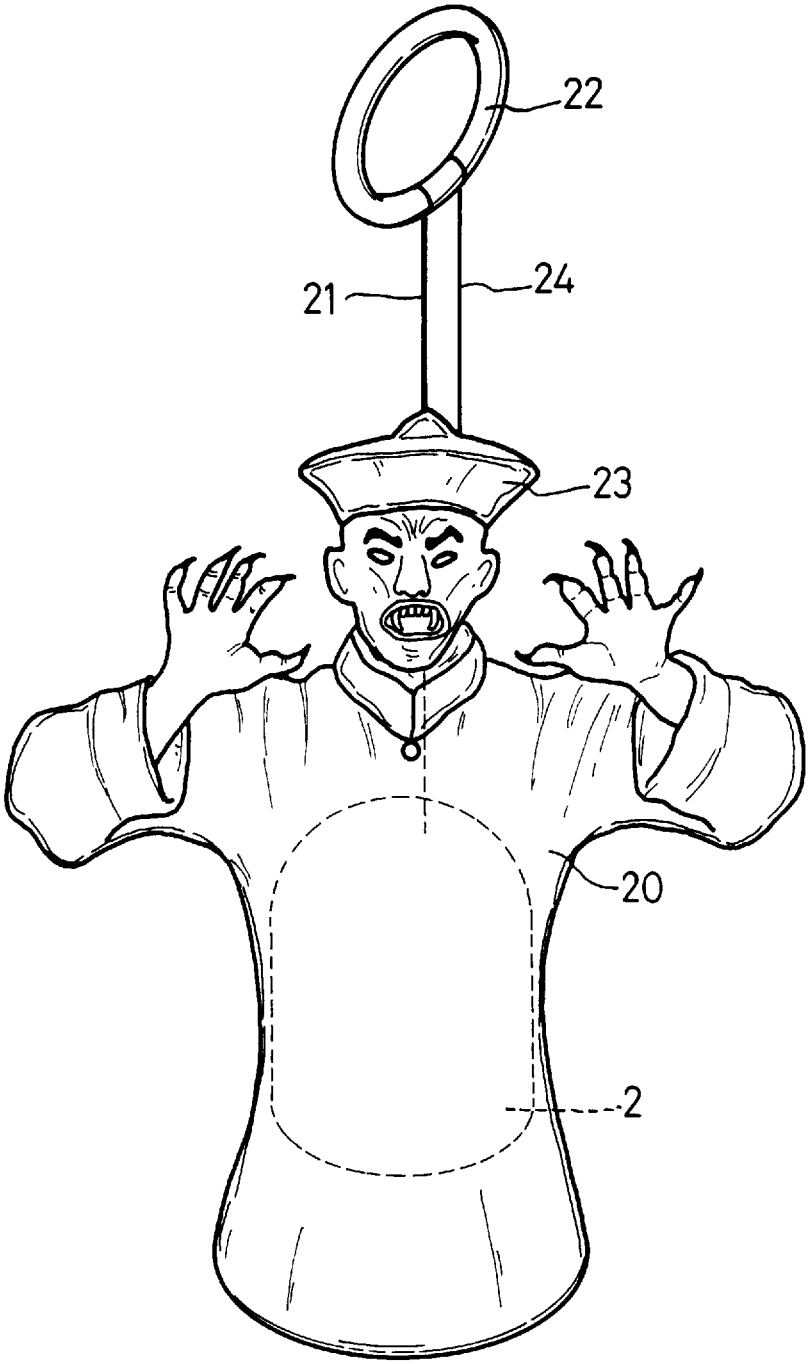
FIG. 3 is a perspective view of a climbing toy device of a preferred embodiment in accordance with the invention while the first climbing toy and the second climbing toy are joined.
Figure 4:
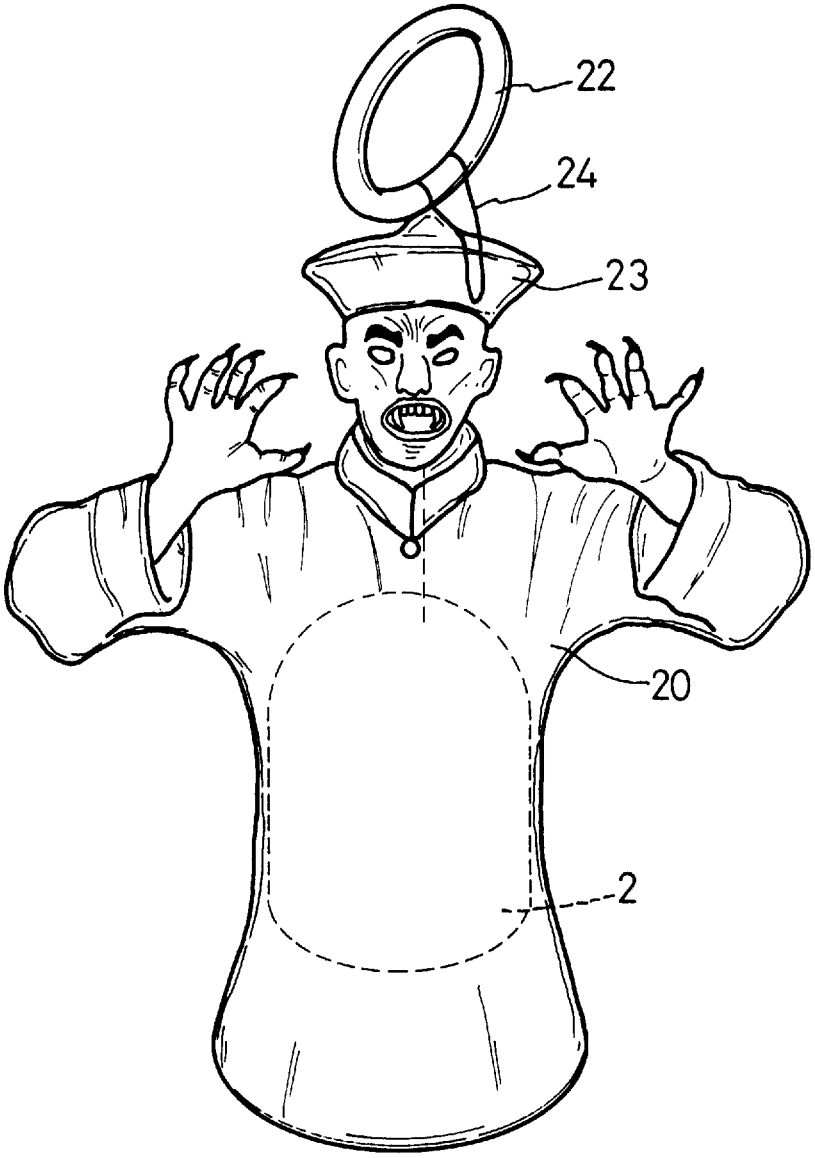
FIG. 4 is a schematic view illustrating an operation of a climbing toy device of a preferred embodiment in accordance with the invention.

Referring to FIGS. 2 to 4, a climbing toy device comprises a ring 22, a first climbing toy 20, a climbing mechanism 2 disposed in the first climbing toy 20, a rope 21 connected to the ring 22 and the climbing mechanism 2, a second climbing toy 23, and a string 24 connected to the ring 22 and the second climbing toy 23. Therefore, the climbing mechanism 2 climbs upward along the rope 21 with the first climbing toy 20. The first climbing toy 20 will touch the second climbing toy 23 and climb upward with the second climbing toy 23. When the second climbing toy 23 touches the ring 22, the climbing mechanism 2 will descend.

Referring to FIGS. 2 to 4 again, the first climbing toy 20 is a torso and the second climbing toy 23 is a head.

Figure 5:
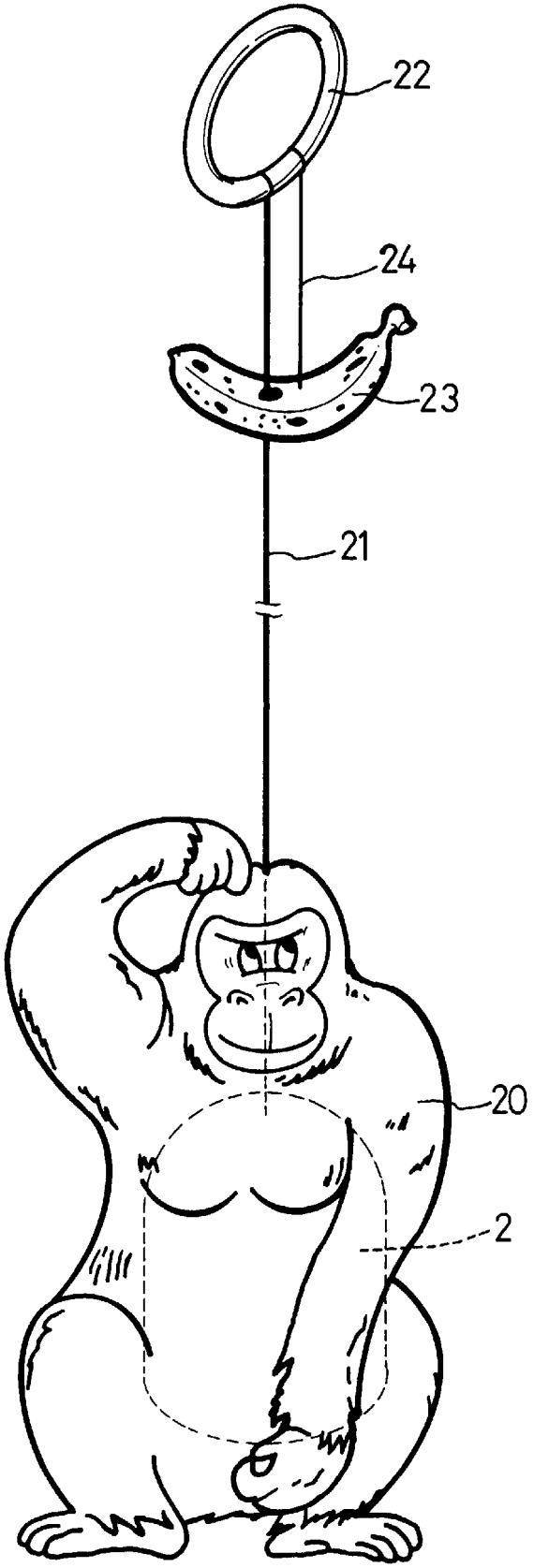
FIG. 5 is a perspective view of a climbing toy device of another preferred embodiment in accordance with the invention.

Referring to FIG. 5, the first climbing toy 20 is a monkey toy and the second climbing toy 23 is a banana toy.

The invention is not limited to the above embodiment but various modification thereof may be made. Further, various changes in form and detail may be made without departing from the scope of the invention.

I claim:

1. A climbing toy device comprising:

a) a ring;

b) a first climbing toy including a climbing mechanism disposed therein;

c) a rope including a first end connected to the ring and a second end connected to the climbing mechanism for permitting the first climbing toy to climb the rope towards the ring upon operation of the climbing mechanism;

d) a second climbing toy supported on the rope and freely movable therealong;

e) a string including a first end connected to the ring and a second end connected to the second climbing toy for positioning the second climbing toy on the rope at a location between the ring and the first climbing toy; and f) wherein when the first climbing toy climbs the rope towards the ring during operation of the climbing mechanism, the first climbing toy will eventually engage the second climbing toy, thereby causing both the first and second climbing toys to continue climbing the rope until the second climbing toy contacts the ring, thereby terminating the climbing action of both toys.

2. The climbing toy device of claim 1, wherein the rope passes through the second climbing toy.

* * * * *